US005634856A

United States Patent [19]

Rainey

[11] Patent Number: 5,634,856

[45] Date of Patent: Jun. 3, 1997

[54] SPORTS SWING TRAINING METHOD AND APPARATUS

[76] Inventor: Ron T. Rainey, 2605 Summertree Dr., Carrollton, Tex. 75006

[21] Appl. No.: 633,508

[22] Filed: Apr. 17, 1996

[51] Int. Cl.[6] ..... A63B 69/36

[52] U.S. Cl. ..... 473/234

[58] Field of Search ..... 473/233, 234, 473/409

[56] References Cited

U.S. PATENT DOCUMENTS

| | | | |
|---|---|---|---|
| 1,418,401 | 6/1922 | Schmidt | 473/234 X |
| 1,676,270 | 7/1928 | Mattison | 473/234 |
| 2,135,648 | 11/1938 | Stumpf | 473/233 |
| 2,203,893 | 6/1940 | Chapman | 473/233 |
| 2,950,115 | 8/1960 | Hurdzan | 473/234 |
| 3,137,504 | 6/1964 | Zordan et al. | 473/234 X |
| 3,897,068 | 7/1975 | Staples | 273/186 A |
| 4,027,886 | 6/1977 | Katsube | 273/186 A |
| 4,614,343 | 9/1986 | Radway | 273/186 A |
| 4,854,585 | 8/1989 | Koch et al. | 273/193 B |
| 4,969,921 | 11/1990 | Silvers | 273/186 A |
| 5,082,283 | 1/1992 | Conley et al. | 273/186 A |
| 5,277,427 | 1/1994 | Bryan et al. | 273/186.2 |
| 5,330,190 | 7/1994 | Oakley, Jr. | 273/186.2 |
| 5,405,138 | 4/1995 | Duran | 273/186.2 |

*Primary Examiner*—George J. Marlo
*Attorney, Agent, or Firm*—John F. Bryan

[57] ABSTRACT

A golf swing training aid, also usable for baseball and tennis training, has a tubular body with provision for a two-handed grip at one end with a central portion, between the handle portion and the opposite end, wherein a weight is confined to move freely along the central portion. The weight strikes a stop at the opposite end, with the travel distance and duration of said weight are such that the weight strikes against the stop at the ball impact point of a properly executed swing.

13 Claims, 5 Drawing Sheets

SPORTS SWING TRAINING METHOD AND APPARATUS

FIELD OF THE INVENTION

The present invention relates generally to sports such as golf and baseball which involve swinging to strike a ball and more particularly to a method and apparatus for training players to swing so as to achieve consistency, accuracy and range.

BACKGROUND AND SUMMARY OF THE INVENTION

Golf is a particularly demanding sport insofar as the form and consistency of a player's swing is concerned. Mastery of the game involves an arsenal of skills, all based upon a sequence of coordinated movements of the entire body, which collectively make up "the swing". After addressing the ball, a properly executed swing starts with a backswing, to a position wherein the club head is taken up and back around to a point above and behind the opposite shoulder. The backswing ends with the wrists being cocked and the players body rotated to bring the club and the target point into the same, generally vertical plane. Then, without raising his or her head, the club head is brought around to strike the ball. The motion generally retraces the backstroke motions and path except that the wrists are uncocked at the bottom of the swing so as to impart maximum velocity to the club head at the point of impact. There are other factors which relate to effectively striking the ball, having to do with gripping the club, body position and stance. These factors can be implemented thoughtfully, but the aforementioned motions must be imprinted on the player's muscle memory so as to be precisely and consistently repeatable. It is of more than academic interest that the motions of hitting a baseball with a bat, or a tennis ball with a racquet, have the same motion sequence requirements for optimum impact.

A major portion of the time and effort a golfer invests in training is, or should be, devoted to analysing, correcting and practicing his or her swing. Most novices come to the game with flawed swing coordination, which is hopefully refined through practice, the advice of fellow players and observation of others. Since practicing a faulty swing tends to perpetuate its flaws, most serious players eventually resort to professional coaching for assistance. The coaching critique is necessarily conveyed in the form of specific "dos and don'ts" as needed to remedy a given swing problem. However, it is not easy for a player to re-conform motions according to critique, and it is even more difficult to carry what is learned over into actual play.

Devices are available for use as a training aid for various aspects of the swing. Incorporated into the aids is some type of mechanism to be activated by club velocity and/or position during the swing for evaluation of some part of the total motion. Such devices are generally intended to replicate the feel of swinging a conventional club, so they have a similar weight and length. This renders the device generally unsuitable to indoor use and rather difficult to carry about unobtrusively. Thus, the training aids presently available are useful in practicing to achieve correct execution of some portion of the swing. Integrating that portion into a smoothly coordinated total movement however, still depends upon driving range practice, the advice of fellow players and observation of others.

The first object of the present invention is therefore, to provide a device for a players use in training the muscle memory aspects of a golf swing as complete motion sequence, from the beginning of the backswing through striking the ball. A second object is to provide such a device in a compact form so as to be usable indoors and also easy and unobtrusive to carry. A third object is to provide this device in a form that will be usable for swing training for other sports such as tennis and baseball and yet another object is that this device be simple, easily and inexpensively manufactured.

The present invention results from the determination that, in spite of the previous teachings of others in the art, an aid for swing training does not need to replicate the heft and feel of an actual club. Rather, the function of the training aid is to guidance and feedback so that the user is coached by its use to follow the proper motion sequence and made aware of any tendency to deviate therefrom. It was determined, through experimentation in development of the present invention, that muscle memory is taught by motion sequence only and that the effort required is irrelevant. Thus, "heft and feel" were discarded as design parameters in favor of purely functional considerations and the weight and length of the present invention are incidental figures.

Following the above considerations, the training aid of the present invention is preferably a tube, but may be a shaft, of a length which may be carried about unobtrusively. A small weight is confined to move freely along a prescribed length of the tube or shaft, so as to impact a stop at the outer end of its travel. A handle portion is provided at the opposite end and a second stop at the handle portion limits the travel of the weight. This length of free travel, and its placement relative to the handle end are such that, when a player uses the aid in going through the motion sequence of a proper swing, the weight strikes the outer stop so as to make a sharp sound at what would be the point of impact with the ball. Having set aside considerations of heft and feel, the handle portion must yet provide for a conventional two-handed grip, so the overall length of the aid is essentially determined by transit time of the weight from handle end stop to outer end stop. The aid coaches the player by firstly, requiring that the weight strike the handle end stop slightly prior to the top of the backswing, before starting the down swing, secondly, by making the player keep his or her head down to judge the impact timing, and thirdly, by rewarding only a properly executed swing motion sequence with the impact sound at the bottom of the swing. If the motion sequence is incorrect, the weight strikes before the bottom of the swing. A positioning cue may also be provided in the form of a colored tab at the handle end. The sight of this cue reminds the player to rotate his or her hands at the top of the backswing so as to hide the color from peripheral vision and effectively align the "club" with the target, to be properly positioned for the beginning of the downswing. The compact length permits using the aid at home or in the office. Reducing the weight, as compared to a regular club, makes many more practice repetitions possible without tiring.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE DRAWINGS

Figures 1, 2, 3:
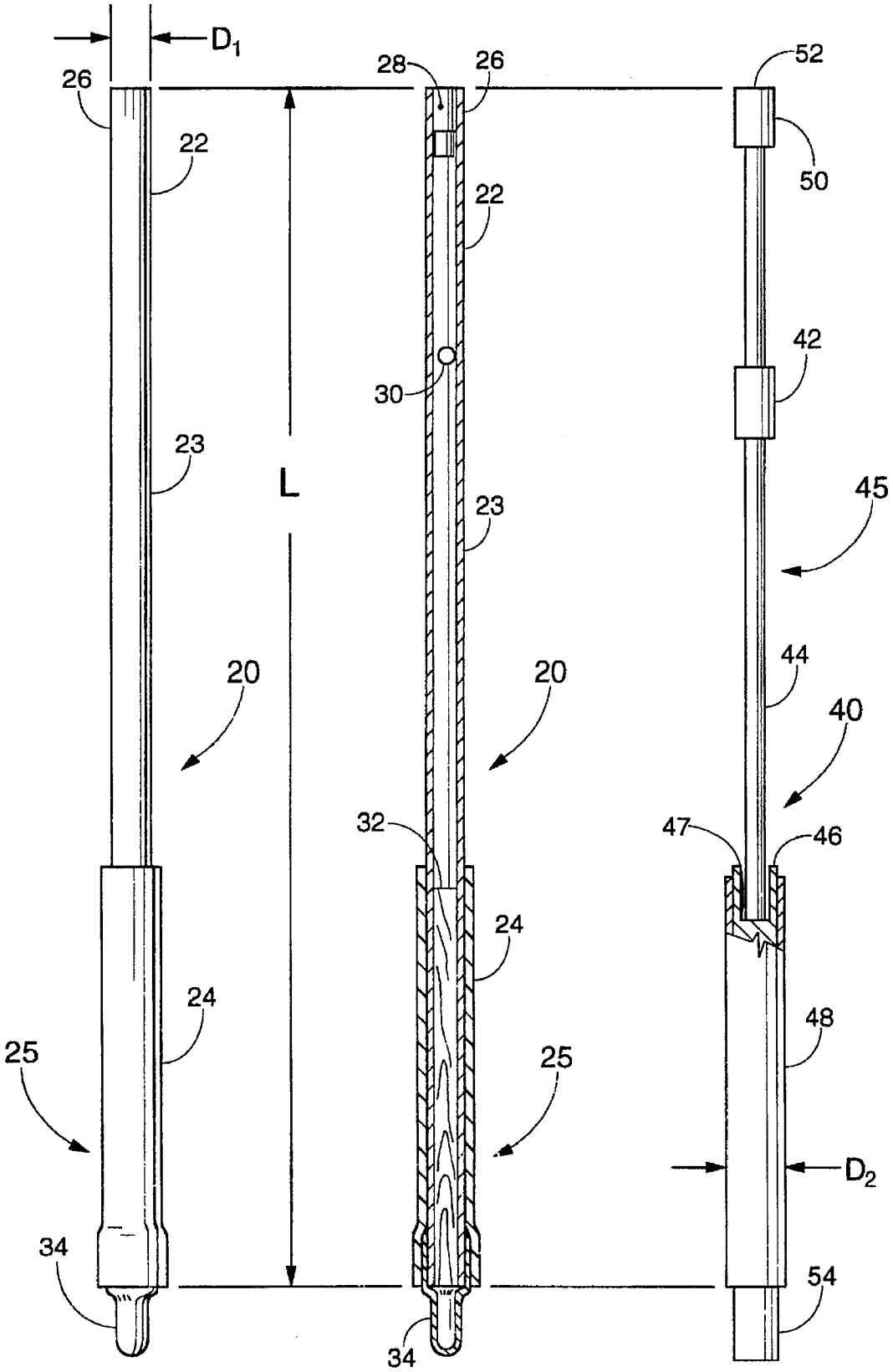
FIG. 1 shows an overall view of a preferred embodiment of the present invention.
FIG. 2 shows a cross-section view of the preferred embodiment of FIG. 1.
FIG. 3 shows an alternative embodiment of the present invention.

FIGS. 1 and 2 show a preferred embodiment of training aid 20 of the present invention, comprising a tubular aluminum body 22 having handle end portion 25 and cushioned two handed grip covering 24, of a material such as neoprene or leather. Body 22 is of convenient overall length, L preferably about 24 inches and of diameter $D_1$, sized for gripping. Opposite end 26 is blocked by end stop 28, which may be of hardened steel, retained in place adhesively or by deforming tubular body 22, as by swaging. The tubular material of end 26 could otherwise be roll-formed, so as to be fully or partially closed, eliminating need for separate end stop 28, but this is less desirable for reasons described below. Striking member 30, which may be a bearing ball element or a weight, preferably made of hardened steel, is loosely confined within tubular body central portion 23 and plug 32 is fitted within handle end portion 25. Striking member 30 moves freely within central portion 23, between plug 32 and end stop 28. The overall length L of the aid is essentially determined by the transit time of striking member 30 from plug 32 to end stop 28, with gripping area 24 being at least 9 inches long, the nominal span of a two-handed grip. Experimentally varying the location of plug 32 within handle portion 25 has determined that body 22 may have an overall length L as short as 12 inches. Moving plug 32 outwardly from the mid-point of handle end portion 25, toward outer end 26, imparts greater outward velocity to striking member 30 at any given rate of angular acceleration, requiring that the overall length of tubular body 22 be increased so as to maintain point of impact timing. Thus, tubular body 22 may be made 36 inches long, or even as long as a conventional club.

As training aid 20 is swung sharply, striking member 30 is caused to strike end stop 28 with an audible impact, reinforced by resonance within the hollow interior of tubular body 22. The hardness of plug 28 allows it serve as an anvil for thousands of such strikes without suffering deformation. Additionally, training aid 20 may also include a brightly colored flag extension 34 of handle end portion 25, the purpose of which is described below.

An alternative embodiment of the present invention is disclosed in FIG. 3 as training aid 40. Weight 42, which is essentially an annular part, preferably of hardened steel, fits loosely on round central shaft portion 44 of body 45. Body 45 also comprises handle end portion 46 of diameter $D_2$, covered by resilient grip 48 and retainer 50 is threaded or otherwise affixed to opposite end 52. Weight 42 can move freely within the length of central shaft portion 44 to the upper limit thereof, where it is confined by stop 47, which may be within handle end portion When training aid 40 is swung sharply, weight 42 is caused to strike against retainer 50 with an audible impact, albeit lacking the resonance lent by the hollow interior of embodiment 20. The length of central shaft portion 44 is such that weight 42 will impact against retainer 50 at the bottom of a properly executed golf swing. Training aid 40 also includes extension 54 of handle end portion 46, brightly colored for the purposes described below.

Figure 4:
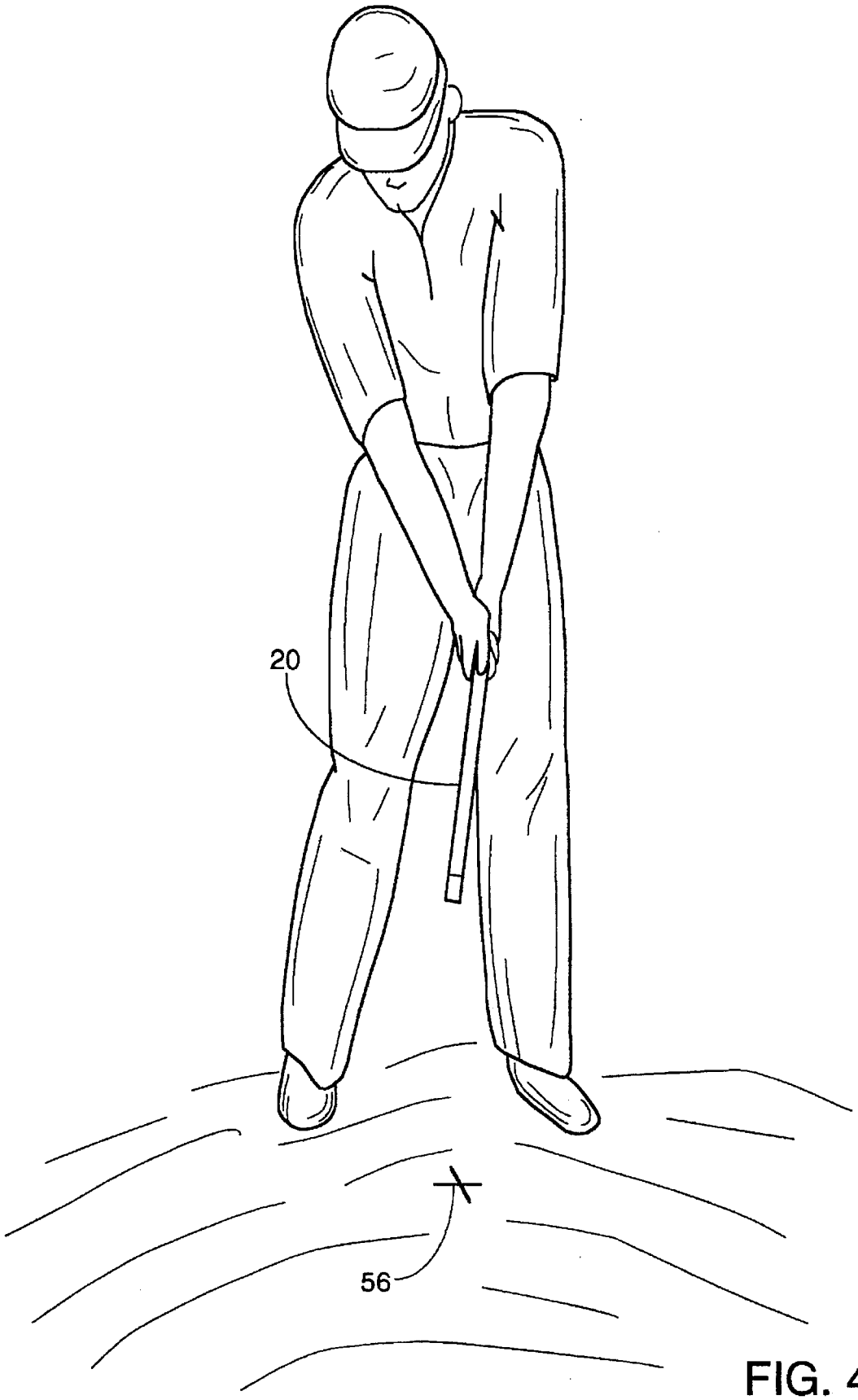
FIG. 4 shows a user of the present invention at the starting position.

FIG. 4 shows a user of the preferred embodiment 20 of the present invention in the starting position of the training swing. As is readily apparent from the illustration, training aid 20 is considerably shorter than a golf club, permitting its use in limited spaces and indoors. An overall length of 24 inches for training aid 20 has been found to be appropriate for both carrying convenience and indoor use. Any significantly greater length tends to restrict carrying convenience and indoor usage, while a significantly shorter length tends to make the judgement of impact timing more difficult The position of FIG. 4 shows the user as addressing a ball placed at point 56 on the floor, which is marked with a coin or the like. This readily learned and practiced initial position should be thoroughly familiar to the user. However, experienced advice should be sought if the user is a raw beginner.

Figure 5:
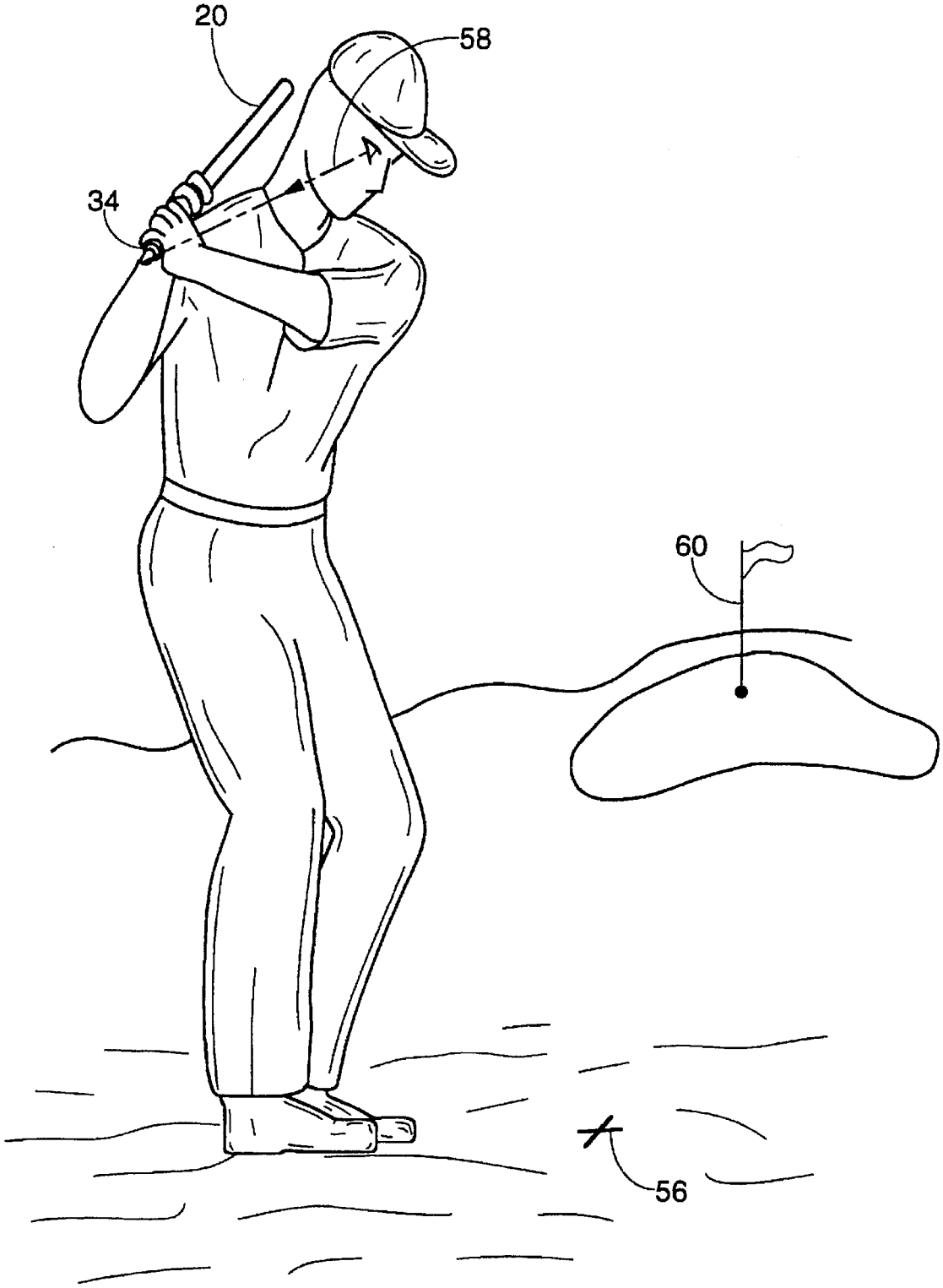
FIG. 5 shows a user of the present invention at the top of the backswing.

FIG. 5 shows training aid 20 taken to the top of the backswing. Again, the slightly bent knees, straightness of the left arm and position of the right arm are pre-learned basics, which every golfer is expected to know. Note, that in this position, the club should be disposed in the generally vertical plane of the target, so that it can be said to "point at" flagstaff 60. The aid coaches the player to cock his wrists and wait at the top of the backswing, until striking member 30 hits against handle end stop 32. This, in effect, discourages an excessively rapid backswing and the resulting loss of tempo and control. At the striker sound, the user is reminded to rotate the shoulders and hands so that brightly colored flag 34, as seen along line 58, is hidden behind his or her left hand. This position effectively places the simulated club in proper alignment with flag 34. The user's head should not move, nor need his or her eye taken away from point 56, inasmuch as flag 34 is within the range of peripheral vision and its bright color is readily discernible.

Figure 6:
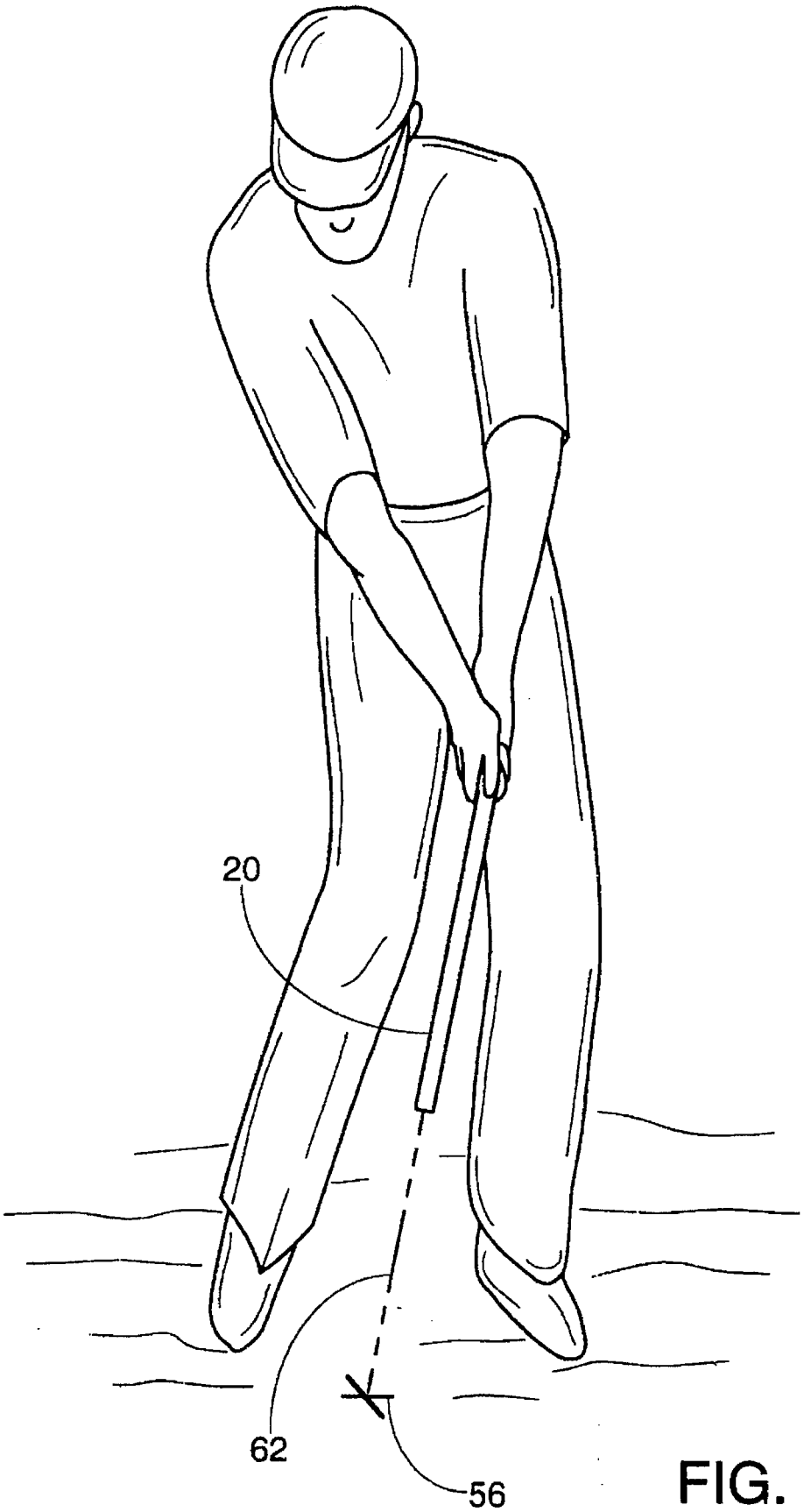
FIG. 6 shows a user of the present invention at the point of impact in the swing.

FIG. 6 shows training aid 20 as it is swung through the bottom of the down swing so that its extended length 62 passes point 56, more or less retracing the path of the backswing. Of particular importance is coordinating the sequence of motions in bringing the shoulders, body and arms and hands around so that the wrists are uncocked at the bottom of the swing. Every component of these movements, shoulder rotation, body rotation, arm swing and wrist action, combines to produce maximum club head velocity at this position, the point of impact. The location of plug 32 and the length of travel in central portion 22 are selected so that striking member 30 will strike against anvil plug 28 at the precise bottom of a properly executed golf swing. The natural tendency of an unskilled player is to un-cock the wrists too soon, spending the velocity contribution of hand motion prior to impact. When this happens, member 30 strikes anvil 28 prior to the bottom of the swing but, when the movements are properly coordinated, the user is rewarded by hearing and feeling the impact of ball 30 on anvil 28 at the instant that end 26 goes through the precise bottom of the swing. Evaluation of this timing requires that head position be maintained and eyes focused on point 56. This inherent requirement in the use of training aid 20 enforces the head position training necessary to a properly executed swing.

Figure 7:
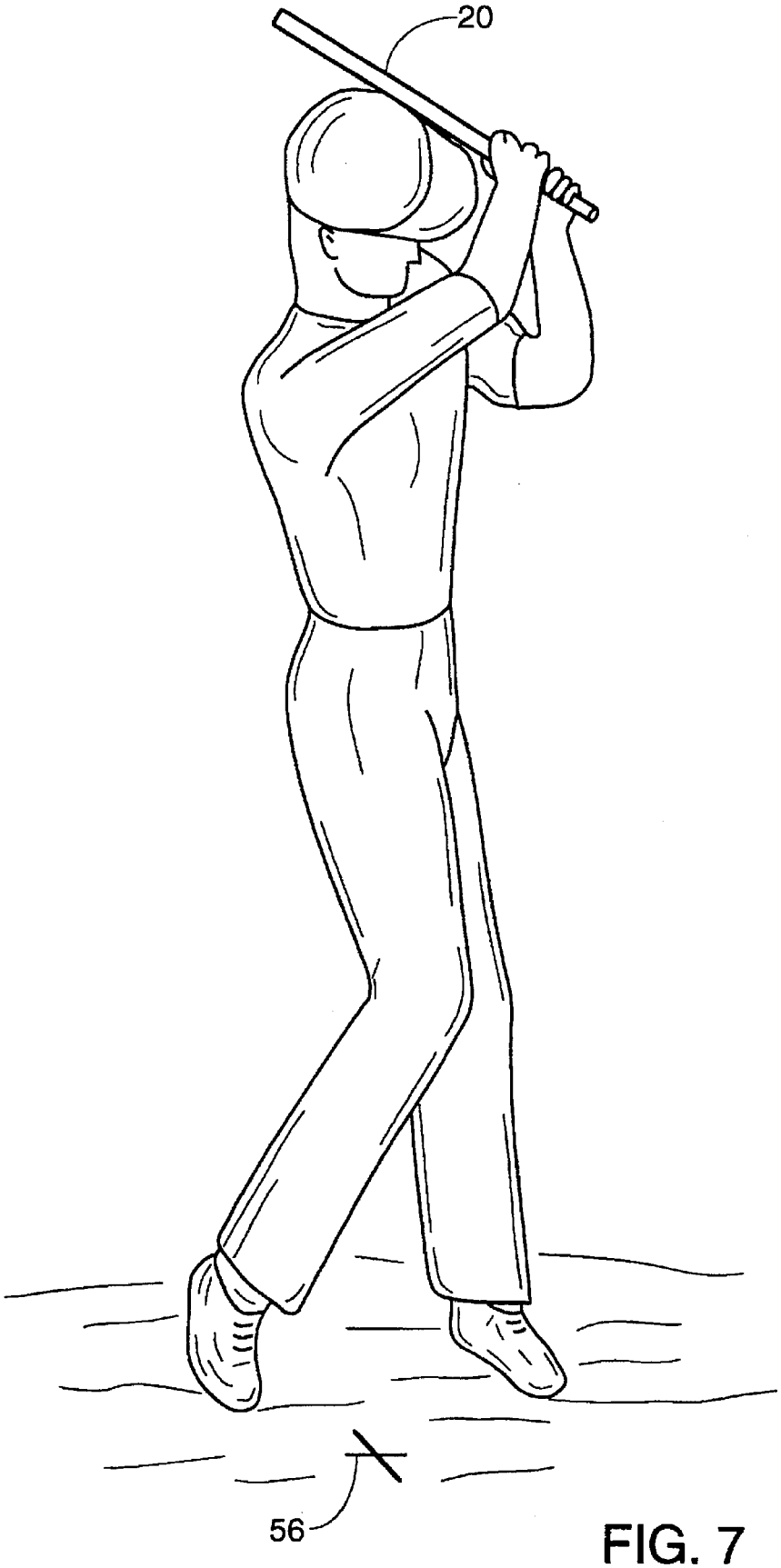
FIG. 7 shows a user in the follow through position at the finish of a swing.

FIG. 7 shows training aid 20 as the follow through is completed. The follow through position has less rotation in this training simulation than in actual practice because of the absence of club head inertia. In truth, anything the player does after impact is academic insofar as the flight of the ball is concerned. However, a properly coordinated swing will finish in a balanced and relaxed follow through position, so any other result advises the trainee of an error in execution.

Thus, working with the pre-learned basics, which can be self critiqued and thoughtfully enforced, the present invention provides the coaching and feedback needed by a trainee for development of skill in the timing and motion sequence of a proper swing. Moreover, since the present invention can be used virtually anytime and anyplace, practice time is not limited by logistics and space restrictions. These attributes, together with its light weight, make it possible to execute many repetitions on a regular basis so that the benefits of muscle memory training are available to all, even the occasional weekend players.

It is to be understood that the present invention is not limited to the disclosed embodiments but may also be expressed in other embodiments, by rearrangement, modification or substitution of parts or steps, within the spirit of the invention.

I claim:

1. A training aid for a player's use in learning the proper motion sequence for swinging to strike a ball comprising:

a body no longer in length than a regulation golf club, with a diameter suitable for gripping, and having an upper end, an upper end portion, a central portion and a lower end;

means for gripping said body with a two-handed grip proximate said upper end, the gripping area extending over said upper end portion;

a striking member located and sized for free longitudinal movement along said central portion;

means located at said upper portion for blocking, but not restraining, longitudinal movement of said striking member, said blocking means thus establishing the upper limit of said central portion at or within said gripping area; and means at said lower end for retaining said striking member within the central portion and for impact of said striking member theragainst, said retaining means thus establishing the lower limit of said central portion, the location of said blocking means and the length of said central portion being selected such that said striking member, upon moving through the length of said central portion under the influence of centrifugal force, will impact against said retaining means at the bottom of a properly executed golf swing.

2. Apparatus according to claim 1 wherein said body is a shaft.

3. Apparatus according to claim 1 wherein:

said body is a tube of between 12 and 36 inches in length of approximately ¾ inch outside diameter; and said striking member is a Weight fitting loosely within said body.

4. Apparatus according to claim 1 wherein:

said body is a tube of approximately 24 inches in length; and said striking member is a weight fitting loosely within said body.

5. Apparatus according to claim 1 wherein said body is a shaft of between 12 and 36 inches in length.

6. Apparatus according to claim 1 wherein:

said body is a shaft of approximately 24 inches in length.

7. Apparatus according to claim 1 wherein said striking member is a flattened part with a central hole fitting loosely around said body.

8. Apparatus according to claim 1 and further comprising;

visually distinctive means adjoining said upper end for aligning the club at the top of the swing by means of the user's peripheral vision, prior to striking the ball.

9. A training aid for a player's use in learning the proper motion sequence for swinging to strike a ball comprising:

a tubular body no longer in length than a regulation golf club, having internal and external diameters, an upper end, an upper end portion, a central portion and a lower end;

a two-handed grip proximate said upper end so that the gripping area extends over said upper end portion of said tubular body;

a striking member, sized for free longitudinal movement within said internal diameter and throughout the length of said central portion;

a plug located in the upper portion of said tubular body, at or within said gripping area, to block, but not restrain, movement of said striking member, said plug establishing the upper limit of said central portion; and an anvil blocking the lower end of said tubular body, said anvil establishing the lower limit of said central portion, the location of said plug and the length of said central portion being such that said striking member, upon moving through the length of said central portion under the influence of centrifugal force, impacts said anvil at the bottom of a properly executed golf swing.

10. Apparatus according to claim 9 wherein:

said body is a tube of between 12 and 36 inches in length having approximately ¾ inch outside diameter; and said striking member is a weight fitting loosely within said body.

11. Apparatus according to claim 9 wherein:

said body is a tube of approximately 24 inches in length having approximately ¾ inch outside diameter; and said striking member is a weight fitting loosely within said body.

12. Apparatus according to claim 9 and further comprising;

visually distinctive means adjoining said upper end for an aid in aligning the club at the top of the swing by means of the user's peripheral vision, prior to striking the ball.

13. A method for training a player in the proper motion sequence for swinging to strike a golf ball comprising:

providing a body of a length no longer than a regulation golf club and of a convenient diameter, with an upper end portion, a central portion and an opposite end;

gripping said body about the upper end portion thereof with a two-handed grip;

providing a weight located and sized for longitudinal movement along the central portion of the body;

blocking, but not restraining longitudinal movement of the weight, with a plug located at the upper end portion at or within the gripping hands;

executing a practice motion sequence as for swinging to strike a golf ball, including:

assuming the initial stance as if addressing a golf ball;

swinging the body back and upwardly to an elevated position causing the weight to slide to the upper end portion plug;

swinging the body downwardly as for striking a golf ball so that the weight slides from the plug to the opposite end of the body under the influence of centrifugal force; and positioning a stop at the opposite end of the body, wherein the length and duration of travel from the plug to the stop is such that the weight strikes the stop at the bottom of a properly executed swing.

* * * * *